US012404757B2

(12) United States Patent
Zitting

(10) Patent No.: US 12,404,757 B2
(45) Date of Patent: Sep. 2, 2025

(54) HYDRAULIC FRACTURING SPREAD AND MECHANISMS

(71) Applicant: Daniel K. Zitting, St. George, UT (US)

(72) Inventor: Daniel K. Zitting, St. George, UT (US)

( * ) Notice: Subject to any disclaimer, the term of this patent is extended or adjusted under 35 U.S.C. 154(b) by 0 days.

(21) Appl. No.: 18/470,215

(22) Filed: Sep. 19, 2023

(65) Prior Publication Data

US 2024/0011382 A1 Jan. 11, 2024

Related U.S. Application Data

(63) Continuation of application No. 17/762,882, filed as application No. PCT/US2021/014004 on Jan. 19, 2021, now Pat. No. 11,761,318.

(60) Provisional application No. 62/962,007, filed on Jan. 16, 2020.

(51) Int. Cl.
*E21B 43/26* (2006.01)
*F04B 47/06* (2006.01)

(52) U.S. Cl.
CPC ..... *E21B 43/2607* (2020.05); *F04B 47/06* (2013.01)

(58) Field of Classification Search
CPC ..... E21B 43/26; E21B 43/2607
See application file for complete search history.

(56) References Cited

U.S. PATENT DOCUMENTS

| | | | | |
|---|---|---|---|---|
| 5,616,009 | A | 4/1997 | Birdwell | |
| 12,252,982 | B1 * | 3/2025 | Hunter | E21B 43/2607 |
| 2009/0269250 | A1 * | 10/2009 | Panagiotou | B01F 25/23 422/129 |
| 2012/0255734 | A1 | 10/2012 | Coli et al. | |
| 2014/0138079 | A1 | 5/2014 | Broussard et al. | |
| 2014/0166267 | A1 | 6/2014 | Weightman et al. | |
| 2015/0322761 | A1 | 11/2015 | Hodgson et al. | |
| 2015/0345272 | A1 | 12/2015 | Kajaria et al. | |
| 2018/0223640 | A1 | 8/2018 | Keihany et al. | |
| 2019/0010793 | A1 * | 1/2019 | Hinderliter | H02P 27/047 |
| 2019/0211661 | A1 | 7/2019 | Reckels et al. | |
| 2021/0207588 | A1 * | 7/2021 | Yeung | H02J 9/066 |
| 2022/0065237 | A1 * | 3/2022 | Cook | F04B 17/06 |
| 2022/0154775 | A1 * | 5/2022 | Liu | F16D 1/10 |

FOREIGN PATENT DOCUMENTS

| | | | |
|---|---|---|---|
| CN | 106677757 | A | 5/2017 |
| WO | 2019169261 | A1 | 9/2019 |

* cited by examiner

*Primary Examiner* — Shane Bomar
(74) *Attorney, Agent, or Firm* — Gurr & Brande, PLLC; Robert A. Gurr

(57) ABSTRACT

A hydraulic fracturing spread system has modular high-pressure fracturing fluid manifold assemblies which couple to form a large trunk line for collecting and conveying high pressure fracturing fluid toward the well bore. Oil-hydraulic intensifier pump units integrated with the modular manifold assemblies increase the fracturing fluid pressure into the trunk line. The manifold assemblies may be configured differently from one to the other and coupleable horizontally and/or vertically.

6 Claims, 7 Drawing Sheets

HYDRAULIC FRACTURING SPREAD AND MECHANISMS

CROSS-REFERENCE TO RELATED APPLICATIONS

This application is a continuation of U.S. application Ser. No. 17/762,882 filed on Mar. 23, 2022, which was a U.S. National Stage Application of PCT/US21/14004 filed on Jan. 19, 2021, which claimed the benefit of U.S. Provisional Application Ser. No. 62/962,007, filed on Jan. 16, 2020, all of which are incorporated herein by reference.

TECHNICAL FIELD

The present disclosure relates to hydraulic fracturing. More particularly, the present disclosure relates to a hydraulic fracturing spread and method.

BACKGROUND

Hydraulic fracturing has been used for years to extract oil and gas from shale reservoirs far below the earth's surface. To release the oil and gas in the reservoirs, a hole is drilled straight down into the earth. A casing is then placed within the hole and cement is introduced to secure the casing in place. After the casing is secure, horizontal drilling follows and another casing is placed into the horizontal section, which allows a perforating gun to enter and puncture holes in the casing. These holes are then ready to receive fracturing fluid pumped at high pressure, causing the fractures that will release oil and/or gas. This process is a form of well stimulation referred to as hydraulic fracturing. There are many possible constituents of fracturing fluid used in various fracturing treatments, but the most common is primarily water mixed with sand and various chemicals. Pressures in excess of 15,000 psi may be required, depending on the specific well geology and the fracturing treatment.

A pressure pumping arrangement for stimulating an oil well typically involves individual pumping units on truck trailers, which pump fracturing fluid for hydraulic fracturing. Flow from each individual truck is collected into a manifold and directed to a wellhead (this system is typically referred to as a "spread"). A typical fracturing treatment may require the flow of fracturing fluid from twelve trucks, each with 3000 horsepower engines pumping the fluid directly with crank-driven plunger pumps. High pressure connections are required between each pump and the manifold. These connections often present safety concerns and require expensive maintenance and replacement due to wear. With as many as twelve trucks, and often more, in a spread, there are many high-pressure connections that have to be continually checked and maintained to avoid accidents. Additionally, spreads usually require a large footprint to operate, which requires preparing a large pad around a well site.

Accordingly, there is a need for a hydraulic fracturing spread that can decrease the length of high-pressure lines and decrease the number of high-pressure connections, while decreasing the typical footprint of the spread. The present disclosure seeks to solve these and other problems.

SUMMARY OF EXAMPLE EMBODIMENTS

In one embodiment, a hydraulic fracturing spread comprises a hydraulic oil tank unit which supplies hydraulic oil at low pressures to manifold assemblies. The hydraulic oil, at low pressure, is sent to low pressure oil-hydraulic manifolds within one or more manifold assemblies. The hydraulic oil is then sent from the oil-hydraulic manifolds to oil-hydraulic pumper units, which increase the pressure of the hydraulic oil and pump the hydraulic oil, now at medium pressure, to intensifier units and valving, each of which are positioned in the manifold assemblies. A fracturing fluid source (e.g., a blender) sends fracturing fluid through low pressure fracturing fluid manifolds to the intensifier pump units, where the pressure of the fracturing fluid is increased to the desired pressure or PSI (e.g., high pressure). The intensifier pumps may be double-acting intensifier pumps or single-acting intensifier pumps. The high-pressure fracturing fluid is then sent to high-pressure fracturing fluid manifolds positioned on the manifold assemblies. The high-pressure fracturing fluid is delivered to a well bore to initiate the fracturing process.

In one embodiment, the oil-hydraulic pumper units comprise diesel-powered pumps. In another embodiment, the oil-hydraulic pumper units comprise electric motors to drive the oil-hydraulic pumps. In another embodiment the oil hydraulic pumper units comprise turbines to drive the oil-hydraulic pumps.

DETAILED DESCRIPTION OF EXAMPLE EMBODIMENTS

Figure 1:
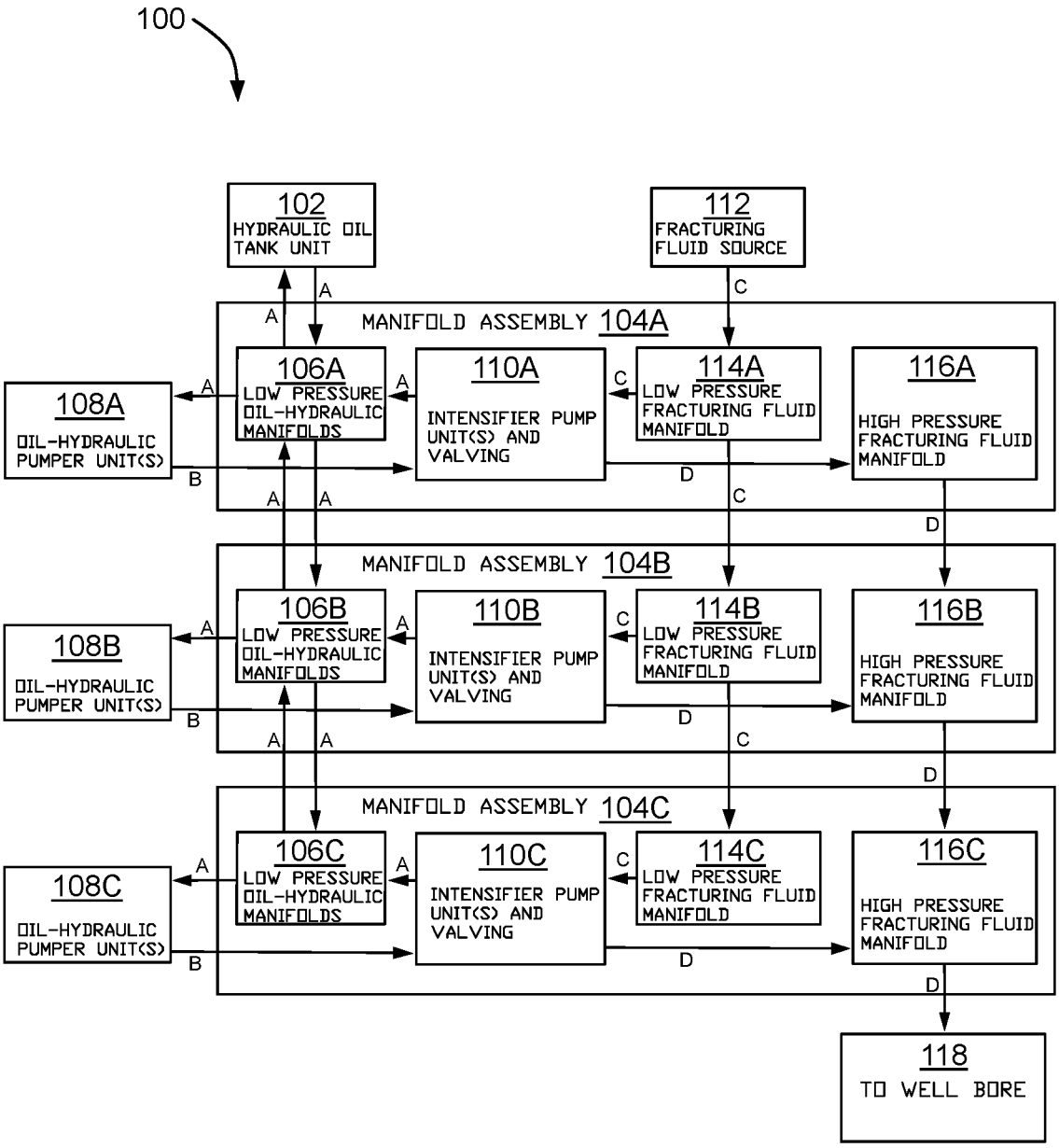
FIG. 1 illustrates a schematic diagram of a hydraulic fracturing spread.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a hydraulic fracturing spread that can decrease the number of pressure pumps, decrease the number of high-pressure connections, and that decreases the typical hydraulic fracturing spread footprint. As will be appreciated, the hydraulic fracturing spread disclosed herein solves these problems and others.

A pressure pumping arrangement for stimulating an oil well typically has individual pumping units on truck trailers, which pump fracturing fluid for hydraulic fracturing. Pressures in excess of 15,000 psi may be required, depending on the specific well geology and the fracturing treatment. Flow from each pumping unit is collected in a manifold and directed to the wellhead. The fracturing treatment may require flow of oil from numerous trucks (e.g., 12 trucks), each having their own pumping unit. High pressure connections are required between each pump and the manifold. These high-pressure lines present safety concerns and require expensive maintenance. This typical spread also requires a large footprint due to the many trucks with pumps and the trucks for transport.

Generally, a hydraulic fracturing spread system described herein comprises manifold assemblies with pressure intensifier pumps. Oil-hydraulic pumps may be coupled separately from a pressure intensifier, where hydraulic oil at medium pressure (e.g., 6000 PSI) drives a piston which pumps the fracturing fluid via a smaller diameter plunger piston. In the pressure intensifier units, the difference of the pressure-affected area of the oil hydraulic piston and the fluid pumping plunger represents an intensification ratio (e.g., 3:1) which, in turn, provides an increase in pressure of the fracturing fluid pumped by the plunger (e.g., 18,000 PSI). It will be appreciated that, due to the aid of the pressure intensifier units, integrated into manifold assemblies which collect and transport the high-pressure fracturing fluid toward the well bore, less length of high-pressure lines is required and fewer high-pressure connections are made on the well site, thereby decreasing safety concerns, increasing efficiency due to less downtime for maintenance. Furthermore, consolidating more horsepower on each oil-hydraulic pumping unit may reduce the number of transportation units and decrease the footprint size required for the spread. Additionally, the manifold assemblies allow a user to easily transport a whole hydraulic fracturing spread from site to site.

Referring to the diagram illustrated in FIG. 1, in one embodiment, a hydraulic fracturing spread system 100 comprises a hydraulic oil tank unit 102 (hydraulic oil source) which supplies hydraulic oil at first, low pressures to manifold assemblies 104A-104C, which are coupled together. More specifically, hydraulic oil at low pressure is sent, for example, via low pressure oil lines (shown as lines A) to low pressure oil-hydraulic manifolds 106A-106C within each of the manifold assemblies 104A-104C. The hydraulic oil is then sent from the oil-hydraulic manifolds 106A-106C at low pressure (lines A) to oil-hydraulic pumper units 108A-108C, which increase the pressure of the hydraulic oil. It will be appreciated that the low pressure oil-hydraulic manifolds 106A-106C are interposed between the hydraulic oil tank unit 102 and the one or more oil-hydraulic pumper units 108A-108C. The hydraulic oil is then pumped at a second, medium pressure flow (shown as lines B) to intensifier units and valving 110A-110C, each of which are positioned in the manifold assemblies 104A-104C. This is a distinction from the prior art, which requires high-pressure connections from the oil-hydraulic intensifiers and the pumper units. By removing these high-pressure connections, safety is increased, downtime and maintenance is reduced, among other things, which is a considerable improvement over the prior art.

A fracturing fluid source 112 (e.g., a blender) sends fracturing fluid through first, low pressure (lines C) to first fracturing fluid manifolds 114A-114C (low pressure manifolds) within the manifold assemblies 104A-104C. These low-pressure manifolds 114A-114C send the fracturing fluid at low pressure (lines C) to the intensifier pump units and valving 110A-110C, where the pressure for the fracturing fluid is increased to the desired PSI. It will be appreciated that the low-pressure manifolds 114A-114C may be interposed between the fracturing fluid source 112 and the intensifier pump units and valving 110A-110C. It further will be appreciated that the intensifier pump units and valving 110A-110C use clean oil-hydraulic pressure to drive and increase the pressure of the fracturing fluid to a second, high pressure fracturing fluid. In some embodiments, as later described, the intensifier pump units and valving 110A-110C may be double-acting intensifier pumps or single-acting intensifier pumps.

The second, high-pressure fracturing fluid is then sent to second fracturing fluid manifolds 116A-116C (high-pressure manifolds), positioned on the manifold assemblies 104A-

104C, via high pressure flow lines (lines D) from the intensifier pump units 110A-110C. The high-pressure flow (lines D) of fracturing fluid is then sent to a well bore 118 to initiate the fracturing process. In some embodiments, the high-pressure flow (lines D) is transported through a large diameter pressure trunk line (shown in FIGS. 4A-5B). Accordingly, the high-pressure fracturing fluid is sent from one manifold assembly to the next via the high-pressure trunk line 131 (FIGS. 4A-5B). In some embodiments, the trunk lines couple the manifold assemblies 104A-104C to each other. While three manifold assemblies 104A-104C are shown, it will be appreciated that one or more assemblies may be used in the hydraulic fracturing spread system 100. The term "well bore" as used to describe 118 is a generalization of the connection to the formation for fracturing. It will be appreciated there are multiple components after the manifold (or "missile") in a typical fracturing spread. For example, instrumentation, valves, a "zipper" manifold which connects to multiple well heads, the well heads themselves, tubing and casing may be part of the connection to the wellbore.

Additionally, each of the manifold assemblies 104A-104C as illustrated in FIG. 1 comprise low pressure oil-hydraulic manifolds 106A-106B, intensifier pump units and valving 110A-110C, low-pressure fracturing fluid manifolds 114A-114C, and high-pressure fracturing fluid manifolds 116A-116C. However, it will be understood that numerous configurations of the manifold assemblies may be envisioned. For example, one manifold assembly may comprise a generator, a hydraulic oil tank, and a portion of trunk line while another manifold assembly may comprise a dual-action intensifier pump, oil-hydraulic pumper units, and a portion of the trunk line, with the rest of the manifold assemblies being configured as shown in FIG. 1. The various manifold assembly configurations may then be coupled together, via the trunk line (e.g., 131 in FIGS. 4A-5B), to create a hydraulic fracturing spread system.

Figure 2:
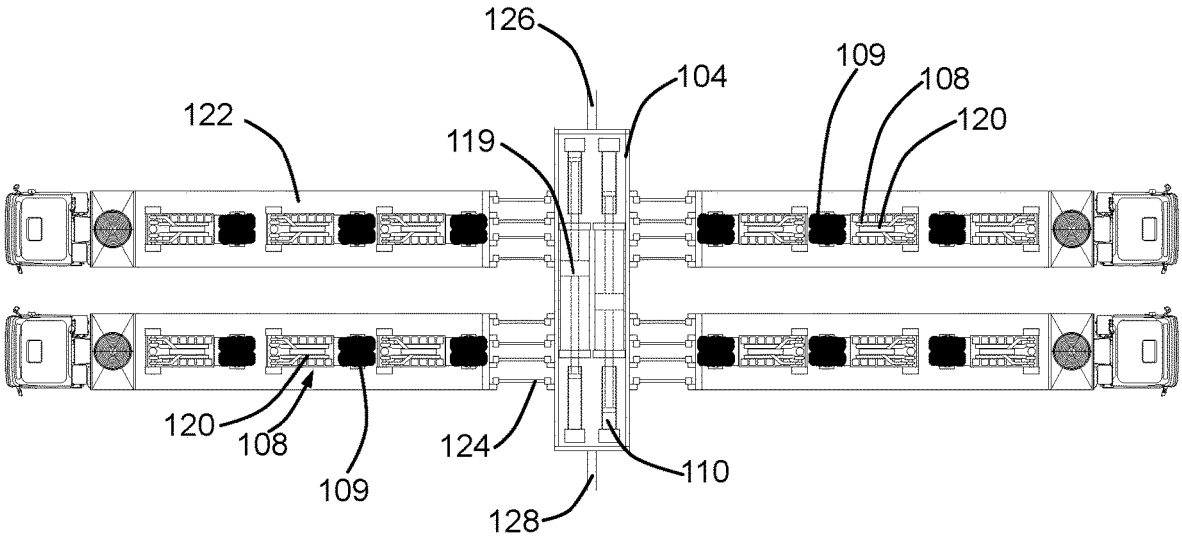
FIG. 2 illustrates a top plan view of a hydraulic fracturing spread.
Figure 3:
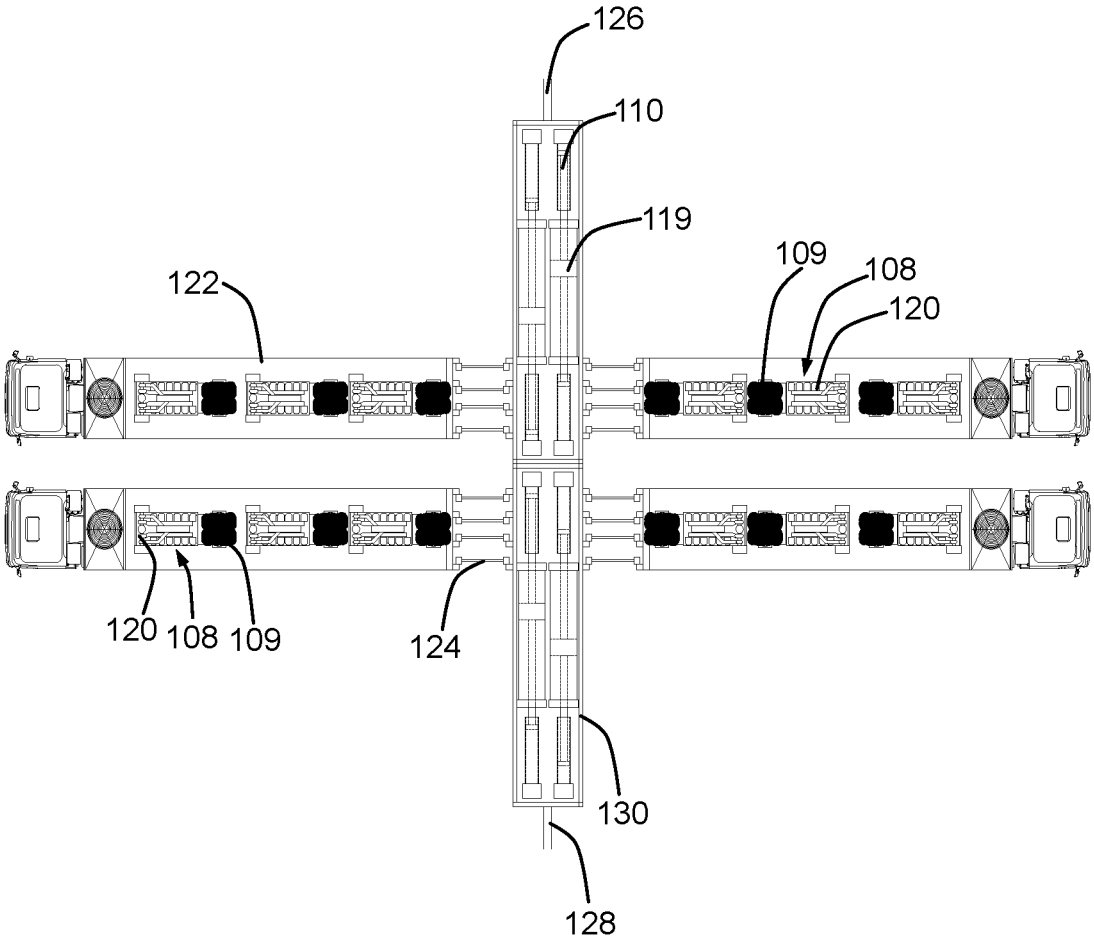
FIG. 3 illustrates a top plan view of a hydraulic fracturing spread.

As shown in FIGS. 2-5B, the oil-hydraulic pumper units 108 may be mounted separately from the manifold assemblies 104 (which comprise the intensifier units and valving 110 (shown in FIG. 1)). In the oil-hydraulic pumper units 108, hydraulic oil at medium pressure (e.g., 6000 PSI) drives a piston 119 which pumps fracturing fluid via a plunger piston (e.g., smaller diameter). The pumper units 108 comprise a pump actuator 120 (e.g., engine, motor, turbine, etc.) that drives a pump 109 of the oil-hydraulic pumper units 108. The pump actuator 120 may be coupled with the oil-hydraulic pumps 109 on a truck trailer 122, skid, or any other location. In one embodiment, multiple pump actuators 120 may be coupled to a truck trailer 122. Thus, the same amount of hydraulic horsepower can be condensed to a smaller footprint (e.g., 4 truck trailer units instead of 12). The example oil-hydraulic pumper units 108 shown in FIGS. 2-3 are illustrated as large piston engines (the pump actuator 120) with a plurality of hydraulic pumps 109 attached to each engine via a geared transfer case. However, it will be appreciated that one or more pump actuators each driving one or multiple pumps can be unitized for a specific application. Oil-hydraulic pumper units 108 refer to a system which increases the pressure of the hydraulic oil and pumps the hydraulic oil at medium pressure.

While the truck-mounted example is shown and described above, it will be appreciated that, in some embodiments, the oil-hydraulic pumping units 108 comprising one or more pump actuators 120 may be mounted to skids and stacked or coupled together with other oil-hydraulic pumping units, and/or with the intensifier pumps 110. Each pump actuator 120 may have multiple oil-hydraulic pumps 109 driven by a gear train (as shown), or one large oil-hydraulic pump may be driven by the pump actuators 120. In some embodiments, the oil-hydraulic pumps 109 are each individually driven by a separate pump actuator 120, such as a motor, engine, turbine, etc. In some embodiments, the pump actuators 120 are internal combustion engines (e.g., diesel or natural gas) or turbine engines. In some embodiments, the pump actuators 120 may be electric motors. The electric motors may be used to drive the oil-hydraulic pumps 109 on the pumper units 108. In some embodiments, a large, central generator (e.g., diesel or turbine) may produce power to drive a plurality of the electric motors (i.e., pump actuators 120) of the oil-hydraulic pumper units 108. Alternatively, turbine or piston engines can be used to power the oil-hydraulic pumps 109, or any other suitable mechanism or prime mover.

Intensifier units and valving 110 may be driven by the oil-hydraulic pumper units 108, or flow from multiple oil-hydraulic pumps may be consolidated to drive individual intensifiers. In particular, the intensifier units may be driven by hydraulic oil sent through oil-hydraulic lines and connections 124 (e.g., medium pressure lines). It will be appreciated that using medium pressure lines 124, and fewer of them than is commonly used on spreads, that connect the oil hydraulic pumps 109 to the pressure intensifier pumps 110 decreases maintenance and decreases the likelihood of accident. In contrast, systems in the prior art use many high-pressure fracturing fluid connections and lines that have to be maintained to avoid accidents. In some embodiments, a double intensifier pump may be used, such as the pump disclosed in U.S. Pat. No. 5,879,137, issued on Mar. 9, 1999, which is incorporated herein by reference. The intensifier pump shown in the prior art is double-acting, where fluid is pumped in both directions of the hydraulic piston's travel. The hydraulic spread system 100 may comprise a single- or double-acting intensifier pump as shown in the prior art. In some embodiments, the oil-hydraulic pumper units 108 and the intensifier units and valving 110 may be mounted together, forming a single unit in the manifold assemblies 104. However, it will also be appreciated that the intensifier units and the valving (e.g., control valves) may be separated from one another. For example, the valving may be located on the oil-hydraulic pumper unit or in any other location that allows for functionality of the valves.

In one embodiment, electronically controlled pumps could be implemented to control flow. Additionally, control valves for oil-hydraulic pumper units 108 may be on the pumping units 108 and/or the intensifier units 110. The hydraulic oil tank unit 102 and cooling may be on each of the truck beds 122 or separate from the oil-hydraulic pumper units 108. For example, one large tank and cooling system can be on a separate truck trailer or skid and shared between multiple hydraulic pump units 108. Accordingly, a large tank can service a plurality of oil-hydraulic pumper units 108. Further, in some embodiments, the manifold assemblies 104 may distribute hydraulic oil flows between themselves (as shown in FIG. 1). For example, low pressure fluid could flow (along lines A) from a large central tank 102 near the blender unit, through a series of connections (lines A) between manifold assemblies 104 to supply oil-hydraulic pumper units 108. Exhausted low pressure hydraulic oil leaving intensifiers 110 and control valves can then return through a series of connections (lines A) between manifold assemblies 104 back to the central tank 102.

Figure 4A:
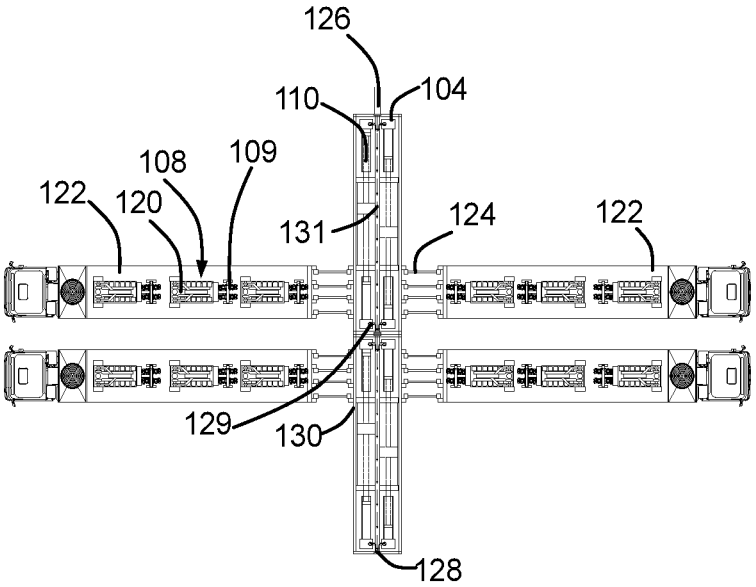
FIG. 4A illustrates a top plan view of a hydraulic fracturing spread.
Figure 4B:
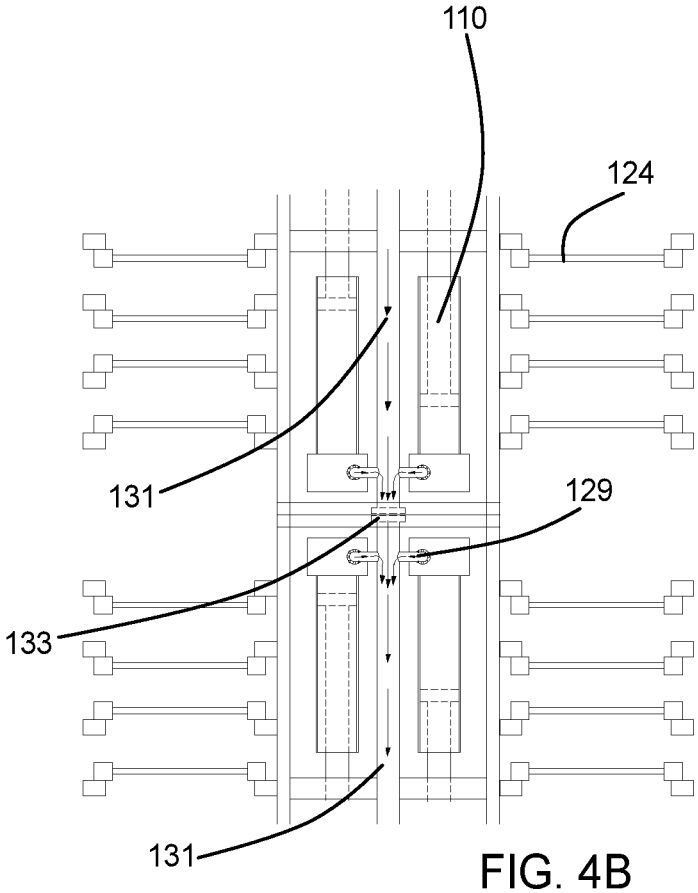
FIG. 4B illustrates a detailed view of manifold assemblies coupled together via a trunkline.
Figure 5A:
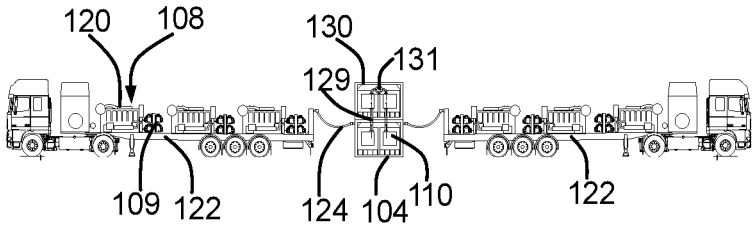
FIG. 5A illustrates a side elevation view of a hydraulic fracturing spread with vertically stacked manifold assemblies.
Figure 5B:
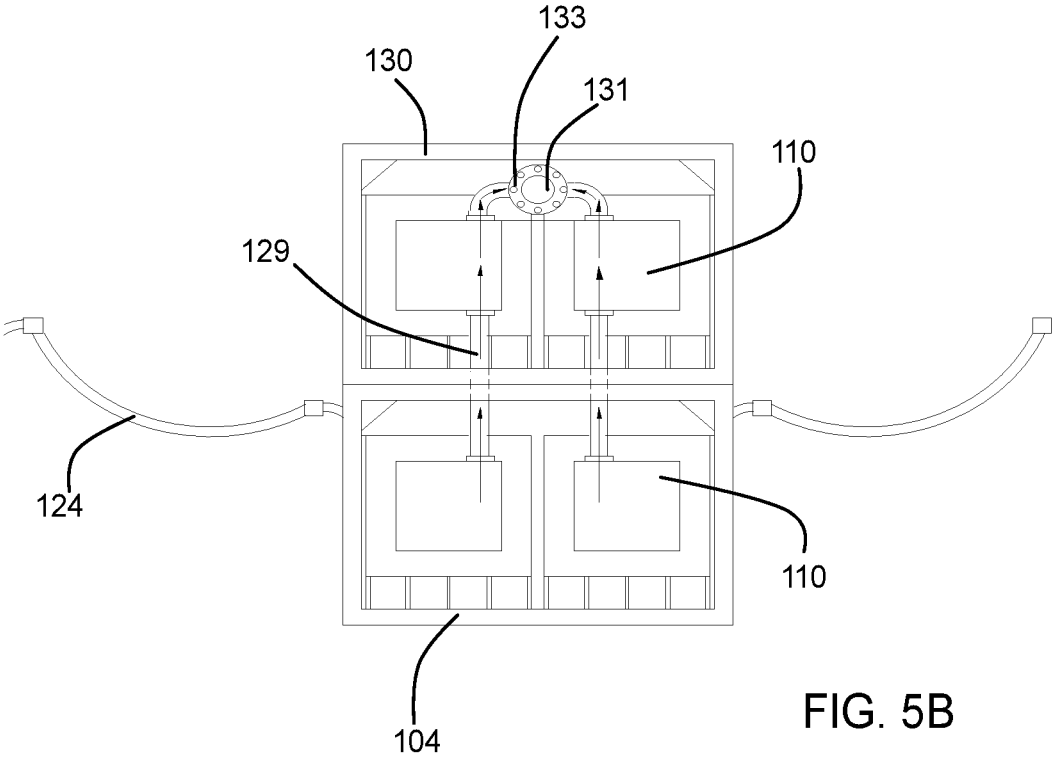
FIG. 5B illustrates a detailed view of manifold assemblies stacked vertically with high pressure fracturing fluid lines.

As previously discussed, fracturing fluid from the fracturing fluid source 112 (FIG. 1) feeds the pressure intensifier manifolds 114 and the intensifier pumps 110 at relatively low pressure via a low-pressure intake line 126 (FIG. 2). High-pressure fracturing fluid is then pumped to a wellhead 118 via a high-pressure output line 128 at a higher pressure due to the intensifier pumps 110. Referring to FIGS. 4A, 4B, 5A, and 5B, the high-pressure fracturing fluid can be moved through high pressure fracturing fluid lines 129 to a trunk line 131 coupled to each of the manifold assemblies 104. Additionally, FIGS. 4A and 4B show manifold assemblies 104 coupled horizontally to each other via the trunk lines 131. In particular, the trunk lines 131 may comprise a joint 133, which allows each trunk line section on each manifold assembly 104 to be coupled to each other. The joint 133 may be a flange with a seal that receives bolts, or any other type of coupler. Furthermore, FIGS. 5A and 5B show manifold assemblies 104 coupled and stacked vertically with the high-pressure fracturing fluid lines 129 connecting the bottom manifold assemblies to the top manifold assemblies through the intensifier pumps 110 to consolidate the flow from the bottom and top manifolds into the trunk line 131. Accordingly, the trunk line 131 runs through each manifold assembly 104. Thus, the oil-hydraulic pumper units 108 may be adjacent to each manifold assembly 104. When multiple manifold assemblies 104 are coupled together, the length of the trunk line 131 increases as well as the number of intensifier units and valving 110. It will be appreciated that having manifold assemblies 104 comprising trunk lines 131 to move the fracturing fluid and intensifier units and valving 110 to increase the pressure of the fluid creates a smaller, easier to maintain layout. Additionally, the manifold assemblies 104 are easily transported and connected with fewer connections than hydraulic fracturing layouts in the prior art, which increases efficiency, decreases energy loss, and decreases the number of high-pressure lines. In some embodiments, the manifold assemblies 104 may comprise a frame/skid 130, allowing the manifold assemblies 104 to be placed directly on the ground. However, it will also be appreciated that components of hydraulic fracturing spreads are commonly transported and used as skids, integrated with a vehicle or as a vehicle trailer assembly. All parts of this system can have any of those options as well for the specific application, or any other means of transporting and placing into service.

Figure 6:
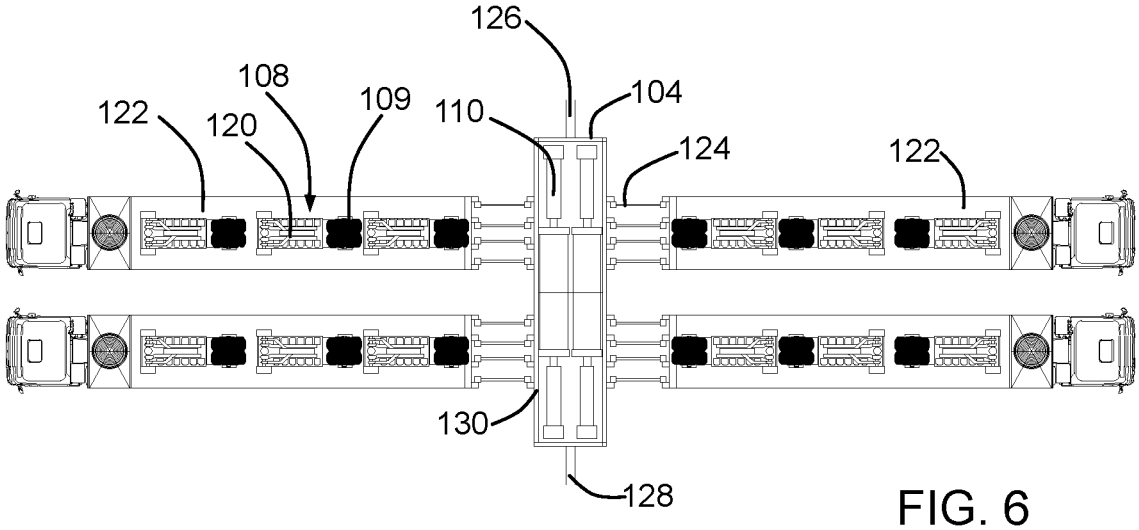
FIG. 6 illustrates a top plan view of a hydraulic fracturing spread.
Figure 7:
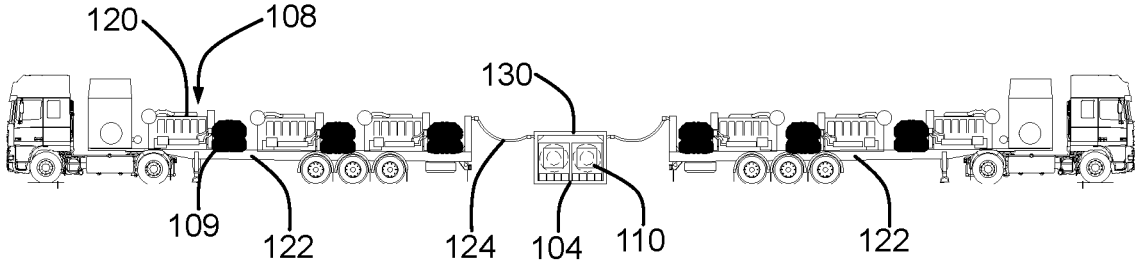
FIG. 7 illustrates a side elevation view of a hydraulic fracturing spread.
Figure 8:
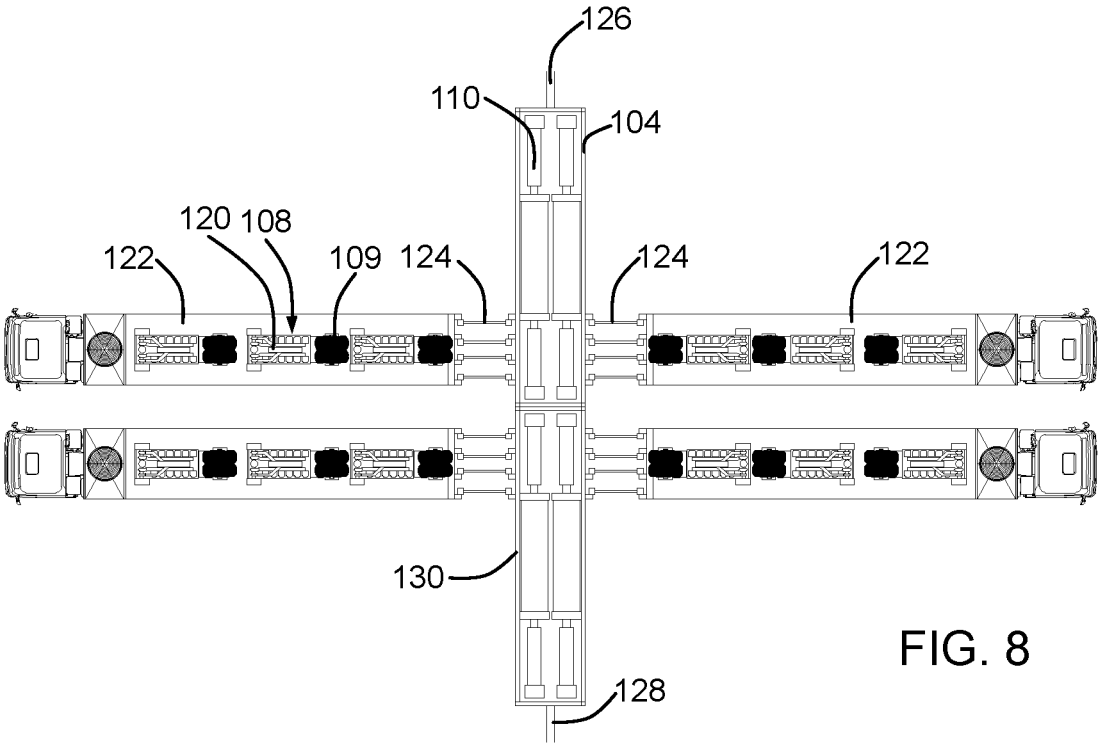
FIG. 8 illustrates a top plan view of a hydraulic fracturing spread with horizontally coupled manifold assemblies.
Figure 9:
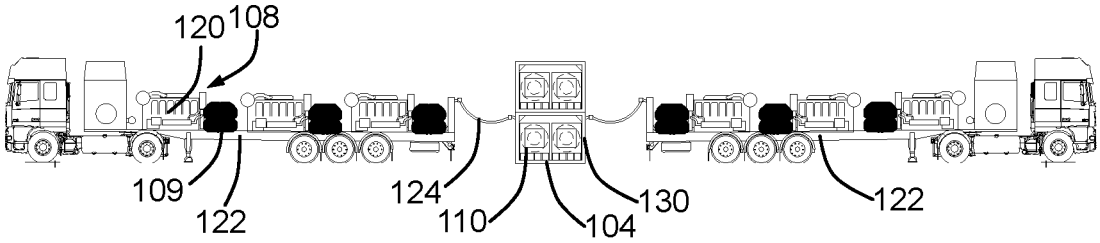
FIG. 9 illustrates a side elevation view of a hydraulic fracturing spread with vertically stacked manifold assemblies.

To supply the pressure and flow requirements for a particular pumping treatment, multiple manifold assemblies 104 with multiple intensifier pump units 110 may be used. As shown in FIGS. 7-8, the manifold assemblies 104 may be coupled horizontally. As shown in FIGS. 6 and 9, in one embodiment, the manifold assemblies 104 may be stacked vertically. Additionally, in some embodiments, the hydraulic spread system 100 may comprise a combination of both vertically stacked manifold assemblies 104 and horizontally coupled manifold assemblies 104. It will be appreciated that any other configuration of the manifold assemblies 104 is within the parameters of the hydraulic spread system 100. The manifold assemblies 104, whether in a vertical or horizontal coupling position, may couple to each other with alignment hardware, such as tapered alignment pins on the skid 130, which may allow for ease of attaching the fluid connections between manifold assemblies 104. For example, API flange connections between manifold assemblies 104 may allow few large diameter connections rather than multiple small diameter connections with swivel joints.

The hydraulic fracturing spread system 100 may condense the footprint further than is possible for truck-mounted units. For example, the system 100 allows multiple manifold assemblies to be stacked. With off-shore applications, for example, footprint must be minimized and ease of loading and unloading equipment by crane is needed. Accordingly, the system 100 decreases footprint size for both land and off-shore applications. Not only is the footprint reduced but the number of connections and lengths required to get the hydraulic fracturing fluid to the high-pressure pumps and to the well bore is reduced. While oil-based fluids were used as examples throughout, the present disclosure is not so limited, and other pressurizable fluids (e.g., water, water and glycol, etc.) may be used without departing herefrom.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A hydraulic fracturing spread layout system, comprising:

a plurality of oil-hydraulic pumping units, each oil-hydraulic pumping unit comprising one or more pump actuators and one or more oil-hydraulic pumps;

one or more first manifold assemblies, the one or more first manifold assemblies comprising at least one intensifier pump and a trunk line;

one or more second manifold assemblies, the one or more second manifold assemblies comprising at least one intensifier pump and at least one high-pressure fluid line configured to couple to the trunk line of the one or more first manifold assemblies to consolidate high pressure fracturing fluid into the trunk line.

2. The hydraulic fracturing spread layout system of claim 1, wherein the plurality of first and second manifold assemblies are vertically coupled to one another.

3. The hydraulic fracturing spread layout system of claim 1, wherein the plurality of first and second manifold assemblies are adjacent and horizontally coupled to one another.

4. The hydraulic fracturing spread layout system of claim 1, wherein at least one of the plurality of first and second manifold assemblies are horizontally coupled and at least one of the plurality of first and second manifold assemblies are vertically coupled.

5. The hydraulic fracturing spread layout system of claim 1, wherein the one or more pump actuators comprise a diesel engine, a natural gas engine, turbine, or motor.

6. The hydraulic fracturing spread layout system of claim 1, wherein the plurality of manifold assemblies each comprise one or more skids.

* * * * *